US005412841A

United States Patent [19]

Lautenschläger et al.

[11] Patent Number: 5,412,841

[45] Date of Patent: May 9, 1995

[54] FURNITURE HINGE

[75] Inventors: Horst Lautenschläger; Reinhard Lautenschläger, both of Reinheim; Gerhard Lautenschläger, Brensbach, all of Germany

[73] Assignee: MEPLA-Werke Lautenschläger GmbH & Co. KG, Germany

[21] Appl. No.: 125,479

[22] Filed: Sep. 22, 1993

[30] Foreign Application Priority Data

Oct. 17, 1992 [DE] Germany ..... 42 35 099.9

[51] Int. Cl.[6] ..... E05D 7/04

[52] U.S. Cl. ..... 16/249; 16/272; 16/383

[58] Field of Search ..... 16/249, 235, 240, 246, 16/247, 248, 257, 272, 382, 383, 384

[56] References Cited

U.S. PATENT DOCUMENTS

| | | | |
|---|---|---|---|
| 4,091,500 | 5/1978 | Lautenschlager | 16/383 |
| 4,376,324 | 3/1983 | Lautenschlager et al. | 16/249 |
| 4,590,641 | 5/1986 | Lautenschlager . | |
| 5,239,730 | 8/1993 | Grass | 16/384 |

FOREIGN PATENT DOCUMENTS

| | | | |
|---|---|---|---|
| 374881 | 6/1984 | Austria . | |
| 1559940 | 3/1972 | Germany . | |
| 2524503 | 12/1976 | Germany | 16/383 |

*Primary Examiner*—P. Austin Bradley
*Assistant Examiner*—Chuck Y. Mah

[57] ABSTRACT

A furniture hinge (10) for hanging a door (12) on a cabinet carcase, whose door-related member (18) is configured as a hinge cup which can be set into a mortise (16) in the inside of the door (12), the hinge cup being composed of the actual cup part (20) lying within the mortise and a mounting flange (22) which can be placed on the area of the inside of the door adjoining the door mortise. In the mounting flange at least one slot (24) running at right angles to the adjacent edge of the door is provided for a mounting screw which can be driven into the door. The cup part (20) engaging in the mortise (16) is undersized with respect to the door mortise such that, when the mounting screw is loosened it can be shifted in the mortise by a given amount at right angles to the door edge. In the cup part (20) at least one spring (32) thrusting against the wall of the mortise (16) is provided, which urges the cup part (20) to a defined initial position within the mortise (16) when the mounting screw or screws (26) are loosened.

15 Claims, 2 Drawing Sheets

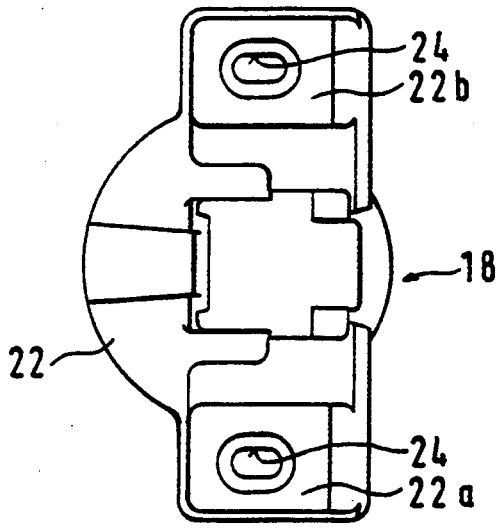
Fig. 2
Fig. 1
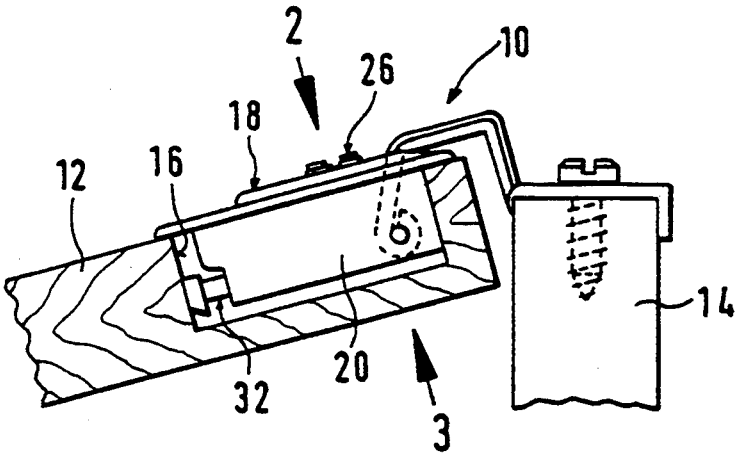
Fig. 3
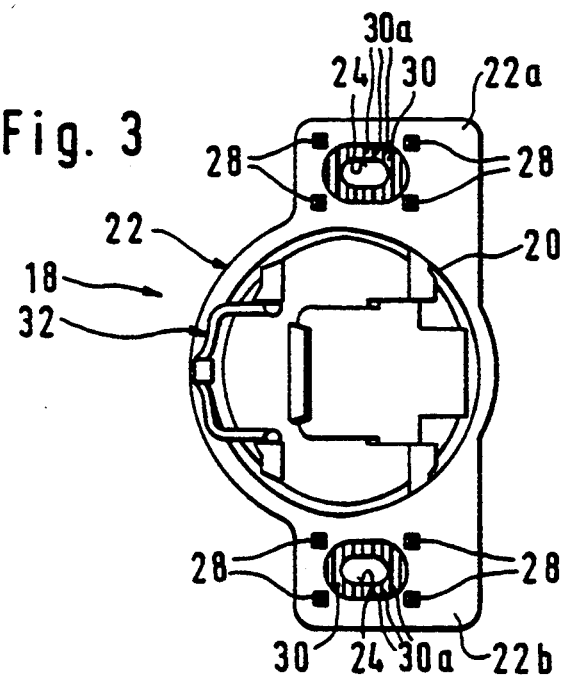
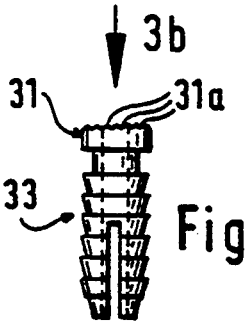
Fig. 3a
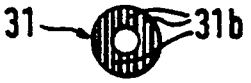
Fig. 3b

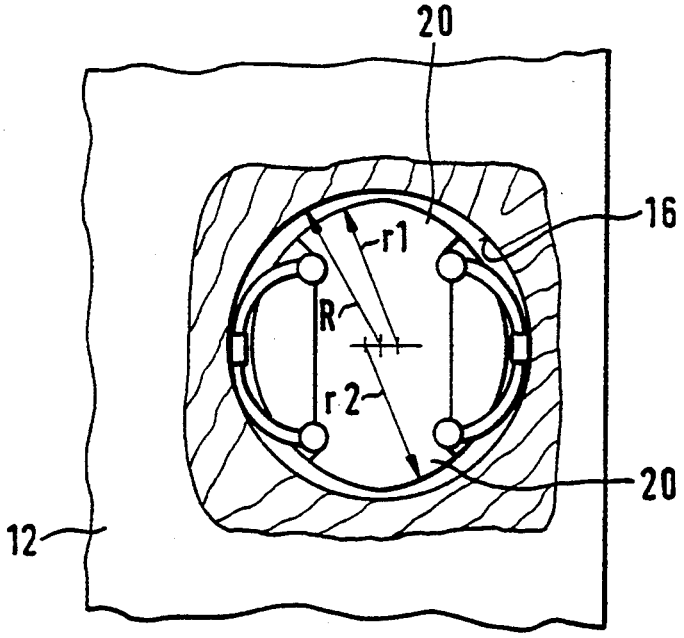
Fig. 4
Fig. 6
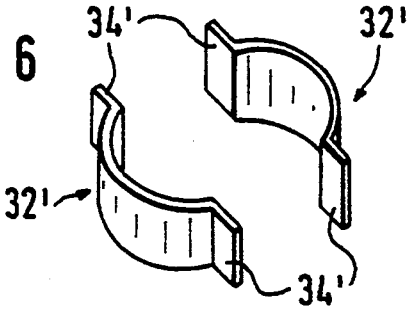
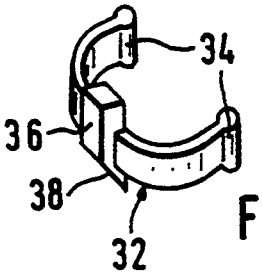
Fig. 5
Fig. 7
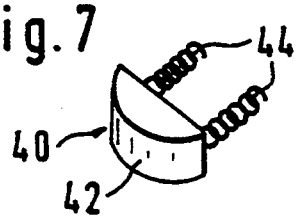
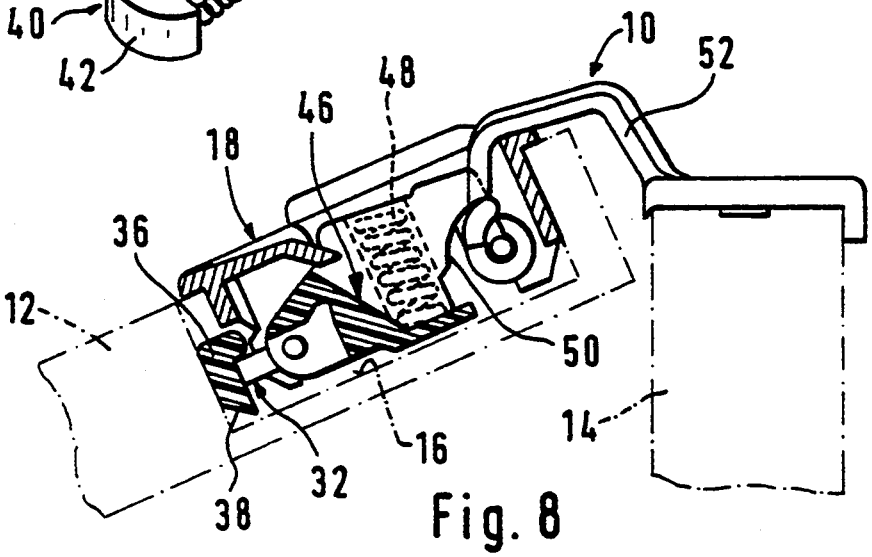
Fig. 8

FURNITURE HINGE

BACKGROUND OF THE INVENTION

The invention relates to a furniture hinge for hanging a door on a cabinet carcase, with a carcase-related member and a door-related member coupled therewith by a linkage mechanism and configured as a hinge cup which can be inserted flush within a mortise in the inner side of the door, the hinge cup being composed of the actual cup part lying within the mortise and a fastening flange adjoining its outer margin which can be placed on the area of the inside of the door adjoining the mortise provided in the latter. In the flange at least one through-opening in the form of a slot running at right angles to the adjacent edge of the door is provided for a mounting screw which can be driven into the door. The cup part engaging the mortise is made undersize with respect to the door mortise such that, when the mounting screw is loosened the cup part can be displaced in the mortise by a given amount at right angles to the door edge.

Modern furniture hinges permit the adjustment of the alignment of the (closed) door relative to the cabinet carcase in at least two, but often also three coordinate directions, namely in a horizontal direction parallel to the side wall (depth adjustment), a horizontal direction at right angles to the side wall (adjustment of the overlap size) and in a vertical direction (height adjustment). The possibilities for adjustment are provided as a rule in the carcase-related member of the hinges, i.e., between the carcase-related member configured often as an elongated supporting arm, and a mounting plate preinstalled on the carcase side wall on which the door is mounted. In exceptional cases it is difficult or even impossible to provide all of the adjustments in the carcase-related part of the hinge. In the case of a cross-link hinge the adjustment of the overlap of a door with respect to the front edge of the wall of the carcase has already been achieved (U.S. Pat. No. 4,590,641)) for an adjustment within its associated mortise of the door-related hinge member configured as a mortise-mounted cup. The cup is bipartite in its area that is to be mounted in the mortise in the door. The actual metal cup part is in the form of a tub flattened on both sides, which is undersized in the desired direction of adjustment with respect to the diameter of the circularly defined door mortise. On this tub body a mounting body made of plastic is premounted, which accommodates the flat-sided tub body in an elongated mortise, the length of the mortise being selected such that the tub body can be displaced by the desired amount in the desired direction of adjustment. The external dimensions of the mounting body, however, are adapted to the diameter of the mortise, so that a tight seat in the mortise is achieved. The fixation of the door-related hinge member at a desired distance from the adjacent edge of the door is done by means of two mounting screws whose threaded shafts are driven into the door through slots provided in mounting flanges projecting laterally from the tub body in the direction of adjustment, and which are tightened to fix the door-related hinge member in the desired setting. This means of adjustment achieved in the door-related hinge member has proven fundamentally good, but the manufacture of the door-related hinge member has proven to be relatively expensive.

The invention, on the other hand, is addressed to the problem of creating a hinge which will be simple and inexpensive to manufacture, designed with an adjustment for the overlap of the door.

SUMMARY OF THE INVENTION

Setting out from a hinge of the kind described above, this problem is solved in accordance with the invention by the fact that at least one spring supported against the wall of the mortise is provided on the cup part and projects beyond its circumferential wall, and urges the cup part toward a defined initial position within the mortise when the mounting screw or screws are loosened. Thus, instead of the complex mounting body, a simple spring is used, which urges the cup part into an initial position, while adjustment can be made by shifting the hinge cup against the spring bias with the mounting screw or screws Loosened, and the adjustment thus made can be set again by tightening the mounting screws.

In a preferred embodiment of the invention, a spring urging the cup part into contact with the wall area of the mortise that is adjacent to the edge is provided in the circumferential area of the cup part opposite the edge of the door when the cup part is in the proper installed position within the mortise. The hinge cup is thus biased by the spring into the position of the least overlap, and any adjustment away from this initial position is possible only in the sense of increasing the amount of overlap.

Alternatively, a configuration is conceivable in which, in the circumferential part of the cup part opposite the edge of the door when the cup part is properly installed within the mortise, a spring urging the cup part in the direction of contact with the portion of the mortise adjacent the edge is provided, and in the circumferential part of the cup part a second spring supported against the wall area of the mortise adjacent the edge is provided which acts in the opposite direction. Then an adjustment of the overlap is possible both to increase it and to decrease it.

The circumferential wall of the cup part facing the wall of the mortise, which is circular in plan, is, in a desirable further development of the invention, arcuately defined in an area adjacent the edge and also in an opposite area remote from the edge, the radius of both arcs being substantially equal to the radius of the circular mortise, but the centers of the radii of the arcuately defined wall areas of the cup part do not coincide, but are displaced each slightly away from its center in the direction in which the cup part is to shift. This brings it about that the cup part will conform to the wall of the mortise in both of the end positions, but on the other hand the undersize of the cup part required for the adjustment is available.

The spring or springs are best configured as bow-like leaf springs held at at least one of their extremities in an associated socket in the cup part.

In that case it becomes possible to manufacture the leaf spring or springs from a resiliently deformable plastic.

It is then also advantageous if the leaf spring or springs are provided in the area in contact with the mortise wall with a thrusting block provided with a ramp surface on its end facing the floor of the mortise in the correct installed position, so that, during installation, the block, which in the relaxed state of the spring would extend beyond the diameter of the mortise, will be forced back, thereby biasing the spring.

If the spring is made of plastic, as mentioned above, it is recommendable that the thrusting block and the spring be made as an integral injection-molded component.

Alternatively, the spring or springs can be made of a spring metal strip material, in which case one face can act directly on the wall of the mortise.

Also, a configuration is possible in which the spring or springs are formed each of at least one compression spring, e.g., a coil spring, which thrusts at one end against the cup part and at the other end is in contact with the thrusting block biased against the wall of the mortise in the door.

If an over-center or clamping device is provided in the hinge cup and has at least one plastic component, e.g., one or more plastic tongues or the like, the plastic spring can also be an integral part of the plastic component of the clamping device.

The fixation of the hinge cup to the door by the tightened mounting screws can be strengthened by providing at least one sharp-pointed or knife-edged projection on the bottom of the mounting flange facing the inside surface of the door.

In that case the configuration is preferably made such that several pyramid-shaped or conical projections are provided in the vicinity of the ends of the slot or slots.

The slot or slots can open at the bottom of the mounting flange facing the inside surface of the door in a countersink of greater length and width dimensions than the slot, whose bottom surface is provided with parallel serrations of tapering cross section running at right angles to the length of the slot, a mounting stud insertable into a corresponding bore in the door being associated with each slot, into which the mounting screw can be driven, and which is provided on the end face confronting its mounting flange with parallel serrations complementary to the serrations in the countersink in the mounting flange.

The mounting studs can advantageously be in the form of plastic plugs each provided on its end facing the mounting flange with a holding flange of greater diameter, whose diameter is substantially equal to the width and whose height is substantially equal to the depth of the countersink surrounding the associated slot.

BRIEF DESCRIPTION OF THE DRAWINGS

The invention will be further explained in the following description of several of its embodiments, in conjunction with the drawing, wherein:

FIG. 1 is a side view of a hinge constructed in the manner of the invention, in the open position of the corresponding door which is represented in cross section.

FIG. 2 is a top view of the door-related hinge member, seen in the direction of the arrow 2 in FIG. 1.

FIG. 3 is a bottom view of the door-related hinge member, seen in the direction of the arrow 3 in FIG. 1.

FIG. 3*a* is a side view of a mounting stud for securing the door-related hinge member to a door of a cabinet carcase.

FIG. 3*b* is a top view of the mounting stud, seen in the direction of the arrow 3*b* in FIG. 3*a*.

FIG. 4 is a top plan view of the outside of a door in the area of a mortise for a hinge cup, the bottom of the mortise being cut open so that a schematically represented cup part of a modified embodiment of a hinge according to the invention is visible.

FIG. 5 is a perspective view of a spring for the hinge cup of a hinge constructed in the manner of the invention.

FIG. 6 is a perspective representation of a pair of springs for a hinge cup constructed in the manner of the invention.

FIG. 7 is a perspective representation of a spring element formed of two coil springs and a thrusting block for the hinge according to the invention, and FIG. 8 shows a section of a hinge similar to the one shown in FIG. 1, in the area of the cup part in which the spring provided according to the invention is combined in an integral unit with a plastic component of a retaining device provided in the hinge cup.

DETAILED DESCRIPTION OF THE INVENTION

A special single-joint cup hinge designated as a whole by the number 10 is schematically represented in FIG. 1, and serves for hanging a door 12 on the carcase of a closet, of which only a style 14 projecting from the lateral wall of the carcase is shown in the drawing. The improvement over the state of the art, however, has to do exclusively with the door-related hinge member configured as a hinge cup 18 which can be inserted in a circular mortise 16 in the door 12, i.e., it is not limited to the special hinge represented, but can be used in all kinds of hinges which are attached to the door by means of such hinge cups.

In FIGS. 2 and 3, therefore, only the hinge cup is represented, in a top view and bottom view, respectively. The hinge cup 18 is composed of the actual cup part 20 engaged in the mortise 16 in the door 12, and a mounting flange 22 which can be placed on the area of the inside surface of the door adjacent the mortise 16, overlaps the door mortise and has on opposite sides two wings 22*a* and 22*b* projecting in opposite directions on opposite sides, and in each of which a countersunk slot 24 is provided, through which the shaft of a mounting screw 26 can be introduced which can be driven into the door. The cup part 20 of the hinge 10 is, as it can be seen especially also in FIG. 4, of such shape and dimensions with respect to the mortise 16 that it has greater clearance at right angles to the direction running at right angles to the adjacent marginal edge. When the mounting screws 26 are loosened the hinge cup can therefore be brought to a selected distance from the door edge within the given clearance and within the length of the slots 24. By tightening the mounting screw it can be fixed in the desired position.

A pair of pointed projections 28 (pyramid-shaped in the case represented) extend integrally from the bottom of the wings 22*a* and 22*b* of the mounting flange 20 facing the inside surface of the door, near to the ends of the slots, and when the mounting screws are tightened these projections penetrate into the surface of the door and thus fix the hinge cup in the selected position in the mortise 16 of the door 12. The slots 24, at their bottom facing the inside surface of the door, are disposed within a countersink 30 (FIG. 3) of greater length and width dimensions, whose floor is provided with parallel serrations 30*a* of pointed cross section running at right angles to the length of the slots 24. With reference to FIGS. 3, 3*a* and 3*b*, these countersinks 30 serve to accommodate snugly a mounting flange 31 of slightly larger diameter of a plastic mounting stud 33 which can be inserted into a blind hole drilled from the back of the door at a lateral distance from the mortise. The fixation of the mounting studs can be accomplished in a known manner either by making the studs oversize with respect to the diameter of the blind hole and shaping its circumference with serrations or by making them like expansion plugs which increase their diameter when the threaded shafts of the mounting screws 26 are driven into them and then presses them against the wall of the blind hole. In the upper side of the serrated floor surface of the countersinks 30 tile mounting flanges 31 of the mounting studs 33 then can best have a complementary serration 31*a* aligned parallel to the edge of the door 12, so that, when the mounting screw is tightened, the parallel serrations come into engagement with the corresponding serrations in the mounting flanges of the mounting studs, thereby again providing fixation of the hinge cup in the selected position.

The hinge cup 18 shown in FIGS. 1 to 3 has in the area opposite the edge of the door a spring 32 projecting beyond the circumferential wall of the cup part 20 and thrusting against the wall of the mortise 16, which is shown separately again in FIG. 5. This spring 32 has in the illustrated case the shape of a bow of spring plastic which is provided at both ends with enlarged holding shoes 34 which can be inserted each into a complementary socket in the cup part 20. In the center of the section of the bow in contact with the wall of the mortise the spring, biased by being bent toward the central axis of the hinge cup, is provided with an integrally formed thrusting block 36 which is provided with a ramp surface 38 at its bottom end which first comes in contact with the upper edge of the mortise. This ramp surface compresses the spring 32 when it is installed in the mortise 16 and then urges the hinge cup as a whole into engagement with the part of the wall of the mortise 16 adjacent the marginal edge. This signifies that the hinge cup is forced by the spring first into a position in the mortise in which the closed door has its minimum overlap on its surface in contact with the cabinet carcase. If the installation of the hinge cup with a overlap of this kind is desired, the hinge cup need only be secured by driving the threaded shafts of the mounting screws into the door through the slots 24 and tightening them so that the head of the mounting screw forces the mounting flange into tight contact with the rear surface of the door. If, however, a greater amount of overlap is desired or required, the shafts of the mounting screws are driven through the slots 24 into the door in a position in which the slots still permit adjustment in the desired direction. Before the final tightening of the mounting screws, the hinge cup then is forced against the bias of the springs 32 into the desired position and both mounting screws 26 are finally tightened, thereby fixing the cup in the selected position.

FIG. 4 shows a schematic plan view of the outside of a door 12 in the area of a mortise 16 for a hinge cup 18, wherein the bottom of the mortise is cut away, so that the cup part 20 of a corresponding hinge cup indicated only schematically is visible within the mortise. It can be seen that, when in the central position shown, the cup part 20 is at a distance on both sides from the wall of the mortise in the direction of adjustment, i.e., at right angles to the adjacent edge of the door 12. This is achieved in the case shown by shaping the cup part such that it is defined in top or bottom view by two arcs whose radii $r_1$ and $r_2$ will be equal to the radius R of the mortise 16, but the centers of radii $r_1$ and $r_2$ will not coincide with the center of the mortise, but will be offset slightly toward the side opposite the associated arcuate boundary from the center of the cup, which, as represented in FIG. 4, coincides with the center of the mortise 16. In FIG. 4, the possibility of arranging two springs 32 at opposite circumferential portions of the cup part 20 is also shown, so that the hinge cup will then, upon installation in the mortise 16, first be placed in the center position represented in FIG. 4, where it will then be possible to vary the overlap either by increasing or decreasing it.

FIG. 6 shows a pair of bow springs 32' made from spring steel, whose outwardly bent end sections 34' can be inserted into associated notches in a corresponding cup part. If both springs 32' are provided on opposite sides of the cup part 20, the latter will then be resiliently biased toward a central position in the same manner as in FIG. 4.

In FIG. 7 an additional alternative configuration of the spring 32 is shown. This is a composite spring element 40 which is composed of a sector-shaped thrusting block 42 and two coil springs 44 spaced apart laterally, which are held at one end in blind holes, not shown, in the thrusting block 42 and in blind holes, also not shown, in the cup part, their length being made such that they bias the thrusting block radially outward beyond the circumferential wall of the cup part. The thrusting block 42 is of an arcuate shape on its side facing the wall of the mortise 16, so that substantially its entire width is in contact with the wall of the mortise 16.

Lastly, in FIG. 8 the hinge 10 shown in FIG. 1 is shown cut away in the area of the hinge cup, along its line of symmetry, while at the same time a cam 46 journaled within the cup part and made of plastic is shown, which is part of an over-center mechanism urged toward the bottom by springs 48. A curve 50 provided on the cam cooperates with lateral projections of the hinge supporting arm 52 such that, as the door approaches the closed position, it is drawn resiliently to the closed position and is held in this closed position. Since the cam is made by injection molding from plastic, it becomes feasible to combine the springs 32 provided according to the invention with the cam 46 to form an integral injection molding, as is represented in FIG. 8.

What is claimed is:

1. A furniture hinge for hanging a door on a cabinet carcase, comprising a carcase-related hinge member and a door-related member coupled therewith across adjacent edges of the carcase and door by a linkage mechanism, the door-related member configured as a hinge cup which can be sunk within a mortise in an inner side of the door, the hinge cup being composed of a cup part lying within the mortise and a fastening flange adjoining an outer margin of the cup part, which fastening flange can be placed on an area of the inner side of the door adjoining the mortise, and in which at least one through-opening in the form of a slot running at right angles to the adjacent edge of the door is provided for a mounting screw which can be driven into the door, the cup part lying within the mortise being made undersize with respect to the mortise such that, when the mounting screw is untightened, the cup part can be displaced in the mortise by a given amount at right angles to the adjacent edge of the door, wherein on the cup part at least one spring is provided thrusting against a wall of the mortise, which at least one spring forces the cup part into a defined initial position within the mortise when the mounting screw is untightened.

2. The furniture hinge according to claim 1, wherein in a circumferential area of the cup part lying opposite the adjacent edge of the door, when the cup part is in an intended installation position within the mortise, the spring urges the cup part into contact with the area of the wall of the mortise that is adjacent the edge.

3. The furniture hinge according to claim 1, wherein in the circumferential area of the cup part lying opposite the adjacent edge of the door, when the cup part is in an intended installation position within the mortise, a first spring urges the cup part in the direction of contact with the area of the wall of the mortise that is adjacent the adjacent edge of the door, and in the circumferential area of the cup part facing the edge a second spring of opposite direction of action to that of the first spring, thrusts against the area of the wall of the mortise adjacent the adjacent edge of the door, which first and second springs together urge the cup part to a defined central intermediate position.

4. The furniture hinge according to claim 1, wherein the mortise is circularly defined, a circumferential wall of the cup part facing the wall of the circularly defined mortise is arcuately defined in an area adjacent the adjacent edge of the door and in an opposite area facing away from the adjacent edge of the door, the length of radii ($r_1$,$r_2$) of the two arcuately defined areas being substantially equal to the length of the radius (R) of the circularly defined mortise, and that the foci of the radii ($r_1$,$r_2$) of the arcuately defined wall areas of the cup part are offset from each other along a line parallel to the slot, the focus of the radius ($r_1$) of the arcuately defined opposite area being a located between a center of the cup apart and the adjacent area, and the focus of the radius ($r_2$) of the arcuately defined adjacent area being located between the center of the cup part and the opposite area.

5. The furniture hinge according to claim 1, wherein said at least one spring is configured as a bow-like leaf spring held at least at one of its ends in an associated socket in the cup part.

6. The furniture hinge according to claim 5, wherein said at least one spring is made from an elastically deformable plastic.

7. The furniture hinge according to claim 6, wherein the plastic leaf spring is an integral part of a plastic component held in the cup part and forming part of a holding system.

8. The furniture hinge according to claim 5, wherein said at least one is spring is provided in the area thrusting against the wall of the mortise with a thrusting block which is provided in its end portion facing the bottom of the mortise in an installed position with a ramp which acts as a cam surface during installation of the cup part into the mortise, whereby the ramp rides along a corner edge of the mortise wall to thereby compress the spring into position against the wall of the mortise.

9. The furniture hinge according to claim 8, wherein the thrusting block and said at least one spring is an integral injection molded component.

10. The furniture hinge according to claim 5, wherein said at least one spring is made from spring-elastic metal strip material.

11. The furniture hinge according to claim 1, wherein said at least one spring is formed by at least one compression spring which thrusts against the cup part at one end and a thrusting block biased into contact with the wall of the mortise in the door at the other end.

12. The furniture hinge according to claim 1, wherein on the underside of the fastening flange facing the inner side surface of the door, at least one pointed or knife-edge-like projection is provided.

13. The furniture hinge according to claim 12, wherein a plurality of pyramid-shaped or conical projections are provided in the vicinity of the ends of the slots.

14. The furniture hinge according to claim 1, wherein the slots open on the bottom of the fastening flange facing the inner side surface of the door in a countersink enlarged in length and width dimensions with respect to the slots, whose floor surface is provided with parallel serrations of pointed cross section running at right angles to the length of the slots, and that with each slot a mounting stud fastenable in a bore in the door is associated, in which the shaft of the mounting screw can be driven, and which is provided on its end facing the mounting flange with parallel serrations complementary to the serrations in the countersink of the mounting flange.

15. The furniture hinge according to claim 14, wherein the mounting stud is configured as a plastic expansion plug which is provided on its end facing the mounting flange with a holding flange enlarged in diameter, whose diameter is substantially equal to the width of the countersink surrounding the associated slot and whose height is substantially equal to the depth thereof.

* * * * *